United States Patent [19]

Possell

[11] 4,347,032

[45] Aug. 31, 1982

[54] METHOD FOR PUMPING SLURRY AND APPARATUS FOR USE THEREWITH

[76] Inventor: Clarence R. Possell, 4842 Viane Way, San Diego, Calif. 92110

[21] Appl. No.: 117,641

[22] Filed: Feb. 19, 1980

Related U.S. Application Data

[63] Continuation-in-part of Ser. No. 858,654, Dec. 8, 1977, abandoned.

[51] Int. Cl.[3] ..... F04D 7/04

[52] U.S. Cl. ..... 415/90; 406/99; 415/121 B; 417/900

[58] Field of Search ..... 415/90, 121 B, 201, 415/213 A, 219 B, DIG. 4; 417/900; 406/99, 101

[56] References Cited

U.S. PATENT DOCUMENTS

| | | | |
|---|---|---|---|
| 1,056,338 | 3/1913 | Johnsen | 415/90 |
| 1,061,142 | 5/1913 | Tesla | 415/90 |
| 2,087,834 | 7/1937 | Brown et al. | 415/90 X |
| 2,245,035 | 6/1941 | Hartman | 415/121 B |
| 3,045,428 | 7/1962 | McLean | 415/90 |
| 3,692,422 | 9/1972 | Girardier | 415/121 B |
| 3,786,996 | 1/1974 | Richter | 415/121 B |
| 3,864,055 | 2/1975 | Kletschka et al. | 415/90 X |
| 4,025,225 | 5/1977 | Durant | 415/90 |

OTHER PUBLICATIONS

New efforts aim at practical application of multiple-disk-pump concept in industry.

*Primary Examiner*—Leonard E. Smith
*Attorney, Agent, or Firm*—William C. Babcock

[57] ABSTRACT

In the method of the present invention, the slurry as it flows from a source thereof is pre-rotated prior to entering a circular vertical confined space that has a cut water discharge in the upper portion thereof. The pre-rotating slurry upon entering the confined space is subjected to the rotary action of first and second laterally spaced circular surfaces that have a number of laterally spaced ring-shaped surfaces situated therebetween. The circular surfaces and ring-shaped surfaces are power driven and rotate concurrently as a unit. As such rotation takes place, the boundary layers of slurry that adhere to the circular surfaces and ring-shaped surfaces are sheared from the balance of the slurry, and the slurry in the confined space rotating as a result thereof. As a result of this rotation, the slurry in the confined space sequentially discharges through the cut water to be replaced by pre-rotating slurry that enters the confined space. Tapered outer edge surfaces on the rotating surfaces direct slurry inwardly to the ring-shaped surfaces to prevent a build-up of solids in the confined space that would jam the rotation of the circular and ring-shaped surfaces. The inner peripheries of the ring-shaped surfaces define knife edges that sever particles in said slurry too large to move outwardly through the spaces between the ring-shaped surfaces into portions that can pass through such spaces.

9 Claims, 3 Drawing Figures

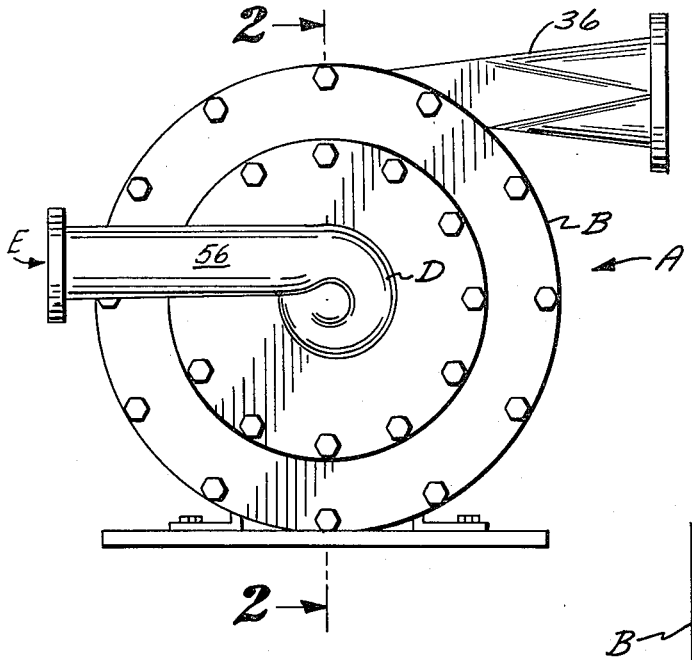
FIG. 1
FIG. 2
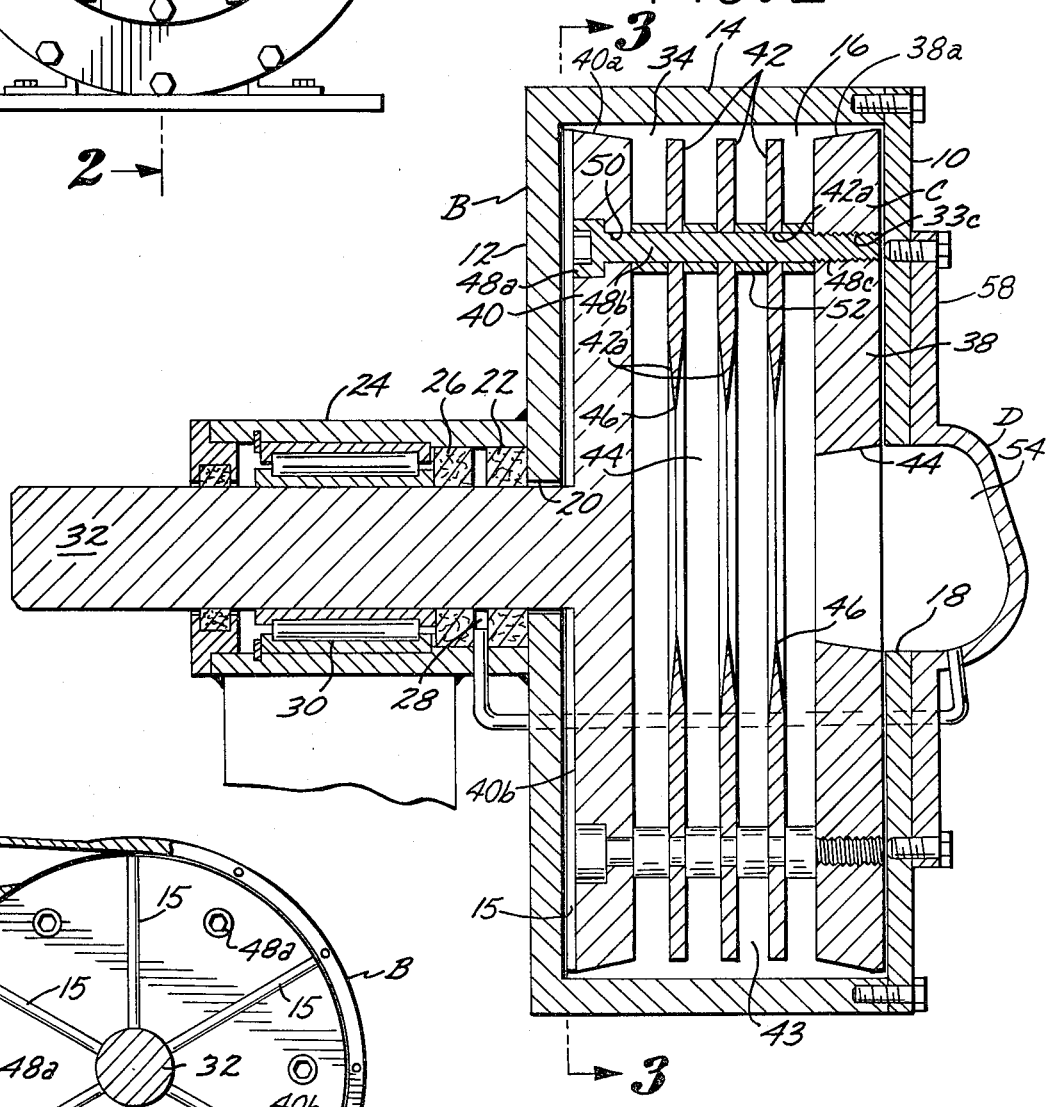
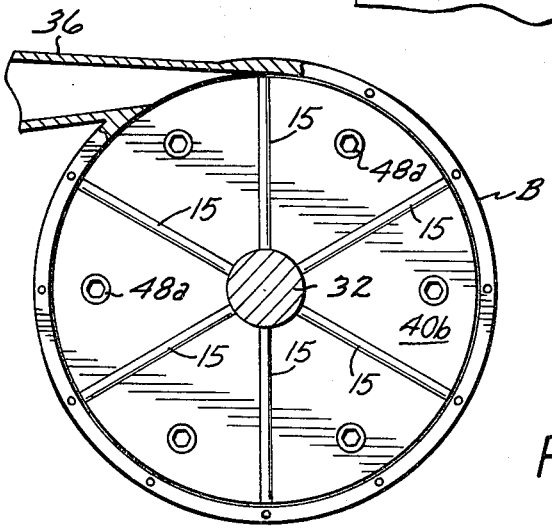
FIG. 3

METHOD FOR PUMPING SLURRY AND APPARATUS FOR USE THEREWITH

CROSS-REFERENCE TO RELATED APPLICATION

The present application is a continuation-in-part of my application entitled "Bladeless Pump and Method of Using Same" that was filed Dec. 8, 1977 in the U. S. Patent Office and identified by Ser. No. 858,654, now abandoned.

BACKGROUND OF THE INVENTION

1. Field of the Invention

Method for Pumping Slurry and Apparatus for Use Therewith.

2. Description of the Prior Art

The pumping of a slurry that has a liquid outer phase and an inner phase comprising particled material has presented serious problems in the past, and particularly when a portion of the particles may be of a size of far greater magnitude than the major portions of the particles. Reciprocating pumps are unsatisfactory for moving such slurries as they are unable to handle large size particles without the risk of jamming. Also, reciprocating pumps have the operational disadvantage that they have a pulsating discharge that is undesirable in that it subjects hoses through which the slurry flows to intermittent high intensity stresses.

A primary object of the present invention is to provide a method and a pump for carrying out the method whereby a slurry having a liquid outer phase and particled inner phase may be transferred from one location to another location at a substantially constant rate and pressure without danger that the particled material will jam the operation of the pump.

A further object of the invention is to furnish a method and pump in which a slurry containing highly abrasive particled material is transferred between locations with the abrasive particles doing a minimum amount of damage to the pump.

A still further object of the invention is to provide a pump of such structure that as it operates the flow of slurry therethrough is so directed that it will not build up and jam the pump, and also the pump operating satisfactorily on slurries containing unusually large particles, with such particles being severed and disintegrated into smaller particles in the pump that can discharge therefrom due to the cutting action of rotating means in the pump that also provide the pumping action.

SUMMARY OF THE INVENTION

In the present invention a method is disclosed whereby a pump transfers a slurry having a liquid outer phase and particled inner phase from a first location to a second location at a substantially constant rate and pressure, and without danger of the particled material settling out and jamming the operation of the pump. In carrying out the method by use of the pump a first vertically extending circular confined space is defined. First and second laterally spaced circular surface defining members are disposed in the confined space, with a number of ring-shaped discs being disposed therebetween. A power-driven shaft extends through a centered sealed opening in the housing that defines the confined space. The shaft is secured to the second circular surface defining member. The ring-shaped discs and the first circular surface defining member are secured to the first circular surface defining member by bolts, and the bolts having spacers thereon that maintain the ring-shaped discs in laterally spaced relationship. The first and second circular surface defining members and the ring-shaped discs rotate concurrently when the shaft is driven.

Prior to the slurry flowing into the confined space means are provided to impart pre-rotation thereto. The pre-rotating slurry as it enters the confined space is subjected to the action of the rotating first and second surface defining members and ring-shaped members that have boundary layers of the slurry adhering thereto, which boundary layers merge into the pre-rotating slurry. The first and second surface defining members and ring-shaped members are rotating at a substantially greater rate than that of the pre-rotating slurry as it enters the confined space. As a result, the boundary layers are constantly sheared from the balance of the slurry in the confined space, and this shearing tending to rotate the slurry in the confined space at the same rate as the first and second surface defining members and ring-shaped discs which is never achieved.

The slurry in the confined space due to the shearing action rotates as a cylindrical body, with the slurry sequentially discharging through a cut water in the upper portion of the confined space, and the discharged slurry being replaced by pre-rotating slurry that enters at substantially the center of the confined space. The slurry after it enters the confined space flows through an outwardly directed spiral path prior to discharging from the cut water.

The individual particles in the inner phase will for the most part be of sufficiently small size as to move outwardly through the spaces between the ring-shaped discs. When an entrained particle is in the slurry that is too large to pass through the spaces between the ring-shaped discs, it will encounter the knife edges defined on the inner peripheries of the discs and be severed or disintegrated as a result thereof to subparticles that will pass through the spaces and be discharged with the slurry through the cut water.

The first and second circular surface defining members have outer peripheral surfaces that taper inwardly towards one another, and serve to direct the outer portion of the rotating body of slurry in the confined space inwardly towards the ring-shaped discs and thus prevent the pump becomming jammed due to particled material building up between the rotor and housing that defines the confined space. The interior of the housing is preferably hardened by nitriding, with layers of porous material thereafter applied thereto, and the voids in the proous material being filled with a material having a low coefficient of friction such as Teflon or the like. The low coefficient of friction minimizes the power required to rotate the body of slurry in the housing that defines the confined space. The side of the second surface defining member most adjacent the housing has a number of radially extending ridges defined thereon, which as the second member rotates tends to pump slurry outwardly in the confined space and away from the seal through which the shaft extends into the housing.

BRIEF DESCRIPTION OF THE DRAWINGS

FIG. 1 is a side elevational view of the slurry pump;

FIG. 2 is a transverse cross-sectional view of the pump taken on the line 2—2 of FIG. 1; and FIG. 3 is a cross-sectional view of the pump taken on the line 3—3 of FIG. 2.

DESCRIPTION OF THE PREFERRED EMBODIMENT

The pump assembly A that may be used to carry out the method of the present invention includes a first housing B. The housing B is defined by a first side wall 10 and second side wall 12. Side walls 10 and 12 are laterally spaced and vertically disposed. An end wall 14 extends between side walls 10 and 12 and cooperates therewith to define a circular confined space 16. The first side wall 10 has a centered opening 18 therein that communicates with confined space 16.

An opening 20 is formed in second side wall 12, with the opening 20 serving as a support for a cylindrical first seal 22. A tubular shell 24 extends outwardly from second side wall and serves to support a second seal 26 in axial alignment with first seal 22. A longitudinal space 28 exists between the first and second seals 22 and 26. A bearing 30 is supported in shell 24 outwardly from second seal 26. A power driven shaft 32 is rotatably supported in bearing 30 and extends through the first and second seals 22 and 26 into the first confined space 16. The end wall 14 in the upper portion thereof in which a cut water discharge 34 is formed that communicates with an outwardly extending tubular diffuser 36. The internal expansion of the diffuser 36 does not exceed 7 degrees on a side thereof.

A rotor assembly C is provided that includes first and second laterally spaced circular members 38 and 40, that may be formed from a heavy steel plate. A centered second opening 44 is formed in first circular member 38, which second opening is axially aligned with first opening 18.

A number of parallel ring-shaped discs 42 are disposed between first and second circular members 38 and 40. The discs 42 have spaces 43 defined therebetween. Discs 42 define a series of axially aligned third openings. The inner peripheries of the ring-shaped discs 42 adjacent the third openings 44 have opposite side surfaces **42*a* that taper inwardly towards one another to meet at an apex which is a circular knife edge 46**.

A number of heavy bolts 48 are provided that have heads **48*a*, shanks 48*b* and threads 48*c* on the end portions of the shanks. A number of circumferentially spaced transverse bores 50 are formed in the outer one third of the second circular member 40 through which the bolts 48 extend towards the first circular member 38. The bolts pass through openings 42*a* in the ring-shaped discs 42. The threads 48*c* of the bolts engage tapped cavities 38*c* defined in the first circular member 38. The heads 48*a* are positioned in enlarged portions of the bores 50**.

Cylindrical spacers 52 are mounted on bolts 48, with the spacers and bolts cooperating to maintain the ring-shaped discs 42 in a fixed relationship with first and second circular members 38 and 40, and also hold the ring-shaped discs 42 in fixed lateral relationship to define spaces 53 therebetween.

A second housing D is provided that defines a second circular confined space 54 into which slurry E flows through a conduit 56 that extends to a source of the slurry (not shown). Housing D is secured to the exterior surface of first side wall 10 by conventional means 58, with an open end of second housing D in communication with first opening 16. The center **54*a* of second confined space 54 is disposed above the center of opening 16**.

Slurry E in flowing through second confined space 54 is pre-rotated and when so rotating discharges into the first circular confined space 16.

The Kinetic energy of the pre-rotating slurry E on entering the first circular confined space 16 is augmented by contact with the concurrently rotating first and second circular members 16 and 18 and the ring-shaped discs 42. Both the circular members 16 and 18 and the ring-shaped discs 42 have thin boundary layers of slurry E that adhere thereto and which boundary layers merge into the balance of the slurry E in confined space 16. The concurrently rotating circular members 16 and 18 and ring-shaped discs 42 are moving at a rate greater than the pre-rotating slurry E. As a result the boundary layers are constantly sheared from the balance of the slurry in the first circular confined space 16. This shearing action imposes a rotary force on the slurry E in the first confined space 16. As the slurry E rotates in the first confined space 16 it is subjected to a centrifugal force, with slurry E after entering the confined space tending to travel outwardly in a spiral path. The kinetic energy imparted to the rotating body of slurry E in first confined space 16 will cause it to sequentially discharge through the cut water 34 into the diffuser where the kinetic energy is recovered.

The first and second circular members have tapered outer edge surfaces **38*a* and 40*a* that extend towards one another, and preferably have an angle that is between 7 and 10 degrees. The tapered edge surfaces 38*a* and 40*a* serve to direct the rotating slurry inwardly towards the ring-shaped discs 42. The edge surfaces 38*a* and 40*a*** also tend to prevent the solid particled phase of the slurry E building up between the rotor C and housing B to the extent the rotor becomes jammed and cannot rotate.

The spaces 43 between the ring-shaped discs 42 are of sufficient width to permit the majority of the solid particles in the slurry E to move outwardly therethrough and then discharge through the cut water 34. Occasionally there will be solid particles E-1 in the slurry E that are of too great cross-section to pass through spaces 43. These particles E-1 are moved outwardly by centrifugal force to pressure contact the rotating knives 46 and be served into particles and fragments that will pass outwardly through the spaces 53.

The particled inner phase of the slurry E is normally of an abrasive nature. To minimize the slurry E having an abrasive action on the spacers 52 the bolts 48 are located on the outer one third of the second circular member 40 where the relative velocity between the slurry and spacers is low. The low velocity reduces the abrasive action on the spacers.

To minimize friction between the rotating body of slurry E in first confined space 16 and the interior of the housing E, the interior surfaces of the first and second side walls 10 and 12 and end wall 14 are nitrided, with a layer of a hard porous material 62 then being applied to the nitrided surfaces. The voids in the porous material 62 are then filled with an anti-friction material such as Teflon.

The side **40*a* of the second circular member 40 most adjacent second side wall 12 has a number of shallow radially extending ridges 15 formed thereon, which ridges when the second member is rotating serve to pump the slurry E outwardly away from the first seal 22. This pumping action results in a longitudinal force being exerted on the rotor assembly C towards the first side wall 10. This force tends to balance the shaft 32 axially due to the imbalance created as a result of the incoming slurry E into the first confined space 16. The space 28 between the first and second seals 22 and 26 is connected to a small bore conduit that extends back to the slurry supply conduit 56**.

The structure of the pump assembly A and the method of suing the same has been described previously in detail and need not be repeated.

What is claimed is:

1. A method of pumping a slurry that has a liquid outer phase and an inner phase that includes a plurality of solid particles, said method comprising the steps of:

a. defining a first vertically extending circular confined space between first and second laterally spaced side surface that are connected on their outer peripheral portions by an end surface, said end surface having a discharge opening in the upper portion thereof, said first side surface having a substantially centered inlet opening for said slurry;

b. disposing first and second laterally spaced circular surfaces in said confined space adjacent said first and second side surfaces, said first surface having a centered opening therein axially aligned with said inlet opening and said first and second circular surface having outer peripheral surfaces that taper inwardly towards one another;

c. disposing a plurality of laterally spaced ring-shaped surfaces between said circular surfaces, said ring-shaped surfaces defining a plurality of centered openings that are axially aligned with said inlet opening;

d. discharging said slurry towards said inlet opening;

e. pre-rotating said slurry to a first rate prior to said slurry entering said inlet opening; and f. concurrently rotating said first and second surfaces and ring-shaped surfaces at a rate greater than that of said pre-rotating slurry entering said confined space, with the rotation of said first and second surface and ring-shaped surfaces relative to said slurry in said confined space shearing boundary layers of said slurry that adhere to said first and second surfaces and ring-shaped surfaces and in so doing importing rotational movement to said slurry in said confined space to cause said slurry to rotate with a desired degree of kinetic energy prior to sequentially flowing through said discharge opening to allow additional pre-rotating slurry to enter said confined space with said pre-rotation minimizing the slippage between said slurry and said first and second surfaces and ring-shaped surfaces, and said taper serving to direct said slurry inwardly towards said ring-shaped surface to have rotational kinetic energy imparted thereto.

2. A method as defined in claim 1 in which a first portion of said particles are of a size too large to pass through the spaces between said ring-shaped surface, and said method including the additional step of:

g. forming the inner peripheries of said ring-shaped surfaces as knife edges that cut said first portion of particles to a size to move outwardly through the spaces between said ring-shaped surface to flow through said discharge opening.

3. A method as defined in claim 1 which includes the additional steps of:

g. securing said second surface to an end of a power driven shaft that extends through a sealed opening in said second side surface; and h. forming a plurality of radially extending ridges on said second surface that are adjacently disposed to said second side surface and serve to pump slurry away from said sealed opening as said shaft rotates said second and first surfaces and said plurality of ring-shaped surfaces.

4. A method as defined in claim 1 which includes the additional steps of:

i. applying a porous rigid material to the interior surfaces of said first and second side surfaces and end surfaces; and j. filling the voids in said porous material with a low coefficient material to minimize the friction between said rotating slurry in said confined space and the interior surfaces of said first and second side pieces and end piece.

5. A pump for discharging slurry that includes a liquid outer phase and an inner phase that is a plurality of particles, said pump including:

a. a first housing assembly that includes first and second vertically disposed, laterally spaced, side walls and a continuous end wall that extends therebetween and cooperates therewith to define a first circular confined space, a centered inlet in said first side wall, a cut water in the upper portion of said end wall, a diverging diffuser extending outwardly from said cut water, a centered opening in said second side wall, a seal operatively associated with said opening, bearing means disposed outwardly from said seal, a power driven shaft that is rotatably disposed in said seal and bearing means, said shaft extending into said confined space;

b. a rotor assembly that includes first and second laterally spaced circular members disposed in said confined space adjacent said first and second side walls, said second circular member secured to said shaft, said first circular member having a centered opening therein axially aligned with said inlet, said first and second circular members of substantial thickness and have outer edge surfaces that taper inwardly towards one another, a plurality of ring-shaped, laterally spaced discs disposed between said first and second circular members, a plurality of circumferentially spaced elongate members that project from the outer portion of said circular members and extend through openings in said discs and have the free ends thereof secured to said first circular members, and a plurality of spacers on said elongate members that maintain said discs in laterally spaced relationship with one another and said circular members, and the inner peripheral portions of said discs defining knife edges;

c. a second housing that defines a second circular confined space into which said slurry flows to have rotational motion imparted thereto, said second housing having the centerline thereof disposed above the centerline of said inlet opening, said second housing supported from said first side wall and in communication with said inlet opening, said second housing supported from said first side wall and in communication with said inlet opening, said rotating slurry as it discharges into said first confined space being transformed into a rotating body of slurry in said first confined space as said first and second circular members and discs shear boundary layers of said slurry that adhere thereto from the balance of said slurry, said slurry as said body thereof rotates in said first confined space sequentially discharging from said cut water and being replaced by slurry that flows into said first confined space from said second confined space, said slurry after entering said first confined space due to centrifugal force imposed thereon flowing outwardly in a spiral path prior to discharging through said cut water with particles in said slurry that are too large to pass through the spaces between said discs being severed by contact with said knives into portions that can pass through said spaces and thereafter discharge through said cut water with said slurry, and said tapered surfaces of said first and second circular members serving to direct said slurry back into said discs away from said end wall to prevent said rotor becoming jammed in said housing.

6. A pump as defined in claim 5 which in addition includes:

d. a porous material adhered as layers to the interior surfaces of said first and second side walls and said end wall; and e. a substance having a low coefficient of friction that fills the voids in said porous material, said substance minimizing the friction between the rotating slurry in said confined space with said housing.

7. A pump as defined in claim 5 in which said elongate members are disposed on the outer third of said second circular member to minimize the relative velocity between said spacers and slurry and lower the abrasive action of said slurry on said spacers.

8. A pump as defined in claim 5 which includes a plurality of said seals that are spaced from one another in addition includes:

d. a plurality of spaced, radially extending ridges on the side of said second circular member adjacent said second side wall, said ridges as said second circular member rotates serving to direct the flow of said slurry between said second side wall and second circular member away from said seal to minimize the possibility of said seal leaking.

9. A pump as defined in claim 8 which in addition includes:

e. conduit means in communication with said spaces between said seals that conduct leaking past said seals back to said second housing.

* * * * *